United States Patent [19]
D'Amato

[11] Patent Number: 4,491,764
[45] Date of Patent: Jan. 1, 1985

[54] ARC SUPPRESSION STRUCTURE FOR AN ELECTRON GUN

[75] Inventor: Ralph J. D'Amato, Lancaster, Pa.

[73] Assignee: RCA Corporation, New York, N.Y.

[21] Appl. No.: 424,139

[22] Filed: Sep. 27, 1982

[51] Int. Cl.³ ..... H01J 29/96; H01J 29/50
[52] U.S. Cl. ..... 315/3; 313/414
[58] Field of Search ..... 315/3, 16; 313/414

[56] References Cited

U.S. PATENT DOCUMENTS

| | | | |
|---|---|---|---|
| 2,957,106 | 10/1960 | Moodey | 313/414 X |
| 3,758,802 | 9/1973 | Kubo et al. | 313/64 |
| 3,882,348 | 5/1975 | Paridaens | 313/450 |
| 3,909,655 | 9/1975 | Grimmett et al. | 313/450 |
| 3,950,667 | 4/1976 | DeJong et al. | 313/450 |
| 3,987,329 | 10/1976 | Yamazaki et al. | 313/414 X |
| 4,032,811 | 6/1977 | Schwartz et al. | 313/417 |
| 4,101,803 | 7/1978 | Retsky et al. | 315/3 |
| 4,124,540 | 11/1978 | Foreman et al. | 252/518 |
| 4,161,673 | 7/1979 | Gregg et al. | 313/481 |
| 4,220,893 | 9/1980 | Miller et al. | 313/450 |
| 4,255,689 | 3/1981 | Fischman et al. | 315/3 |
| 4,288,719 | 9/1981 | Hernqvist | 313/457 |
| 4,334,169 | 6/1982 | Takenaka et al. | 313/449 X |
| 4,345,185 | 8/1982 | Kobori | 315/3 |

FOREIGN PATENT DOCUMENTS 1273703 7/1968 Fed. Rep. of Germany .

OTHER PUBLICATIONS

J. W. Schwartz et al., "Recent Developments in Arc Suppression for Picture Tubes", Zenith Radio Corporation.

Y. Kobori et al., "A Novel Arc-Suppression Technique for Cathode Ray Tubes", IEEE Chicago Spring Conference on CE, Jun. 19, 1980-Sony Corporation.

*Primary Examiner*—Palmer Demeo
*Attorney, Agent, or Firm*—Eugene M. Whitacre; Dennis H. Irlbeck; Vincent J. Coughlin, Jr.

[57] ABSTRACT

An electron gun having at least one arc-suppression resistor located in a zero electric field gradient area of the electron gun is described. In the electron gun, at least one cathode is provided for generating an electron beam. A plurality of electrodes are also provided for directing the beam along the beam path. The electrodes include at least one accelerating and focusing electrode which is a split member having two spaced apart sections. The electron gun also includes at least one arc-suppression resistor which interconnects the spaced apart sections of the split electrode and is located in a zero electric field gradient area of the split member.

9 Claims, 6 Drawing Figures

ARC SUPPRESSION STRUCTURE FOR AN ELECTRON GUN

BACKGROUND OF THE INVENTION

The present invention relates to electron guns having arc suppression resistors and particularly to an electron gun for a cathode ray tube, such as a color picture tube, in which the arc suppression resistors are located in a zero electric field gradient area of the electron gun.

A conventional color television picture tube consists of an evacuated envelope having a neck portion, a faceplate, and a funnel portion therebetween. An electron gun is disposed in the neck portion of the envelope, and a tricolor emitting phosphor screen is disposed on the interior surface of the faceplate. A shadow mask is located between the electron gun and the screen, in spaced relation to the screen. The electron gun comprises a plurality of electrodes for focusing and accelerating three electron beams toward the phosphor screen. The electrodes are supported as a unit from at least two elongated, axially-oriented support rods in the form of glass beads. The beads have extended surfaces closely spaced from the facing the inner surface of the glass neck. Typically, several high voltage and low voltage electrodes are serially attached to the support rods along the electron beam paths to facilitate the focusing and accelerating of the electron beams. The high voltage electrodes typically operate at an ultor potential of about 30 kilovolts, and the low voltage electrodes typically operate at about 8 to 10 kilovolts or less; however, in some electron guns, an intermediate potential of about 12 kilovolts and a low potential of about 8 kilovolts or less are utilized. A conductive coating having a resistance of about 100 ohms is disposed on the interior surface of the funnel portion of the envelope. The interior conductive coating operates at ultor potential. Bulb spacers mounted on the electron gun electrode nearest the phosphor screen contact the interior conductive coating to provide ultor potential to the electron gun. An exterior conductive coating, electrically isolated from the interior conductive coating, is provided on the outside of the funnel to facilitate grounding of the envelope. The interior and exterior conductive coatings on the funnel serve as a large capacitor which filters the high voltage.

The large voltage difference established between the high voltage and low voltage electrodes in the electron gun creates a possibility of arcing between the electrodes. The possibility of arcing is increased by irregular electrode surfaces, foreign matter in the interelectrode gaps and by misalignment or improper spacing between electrodes. When an arc occurs, the high voltage filter capacitor will, within a few microseconds or less, discharge its stored charge.

Because the instantaneous peak arc currents can approach hundreds or even thousands of amperes in magnitude, great destruction can be caused by such arcs. The external electron gun circuitry can be damaged by transient currents and voltages induced into the associated receiver circuitry. The gun electrodes can be burned or eroded to the point of inoperability, and electrode material may be sputtered onto adjacent surfaces resulting in the creation of leakage paths between tube elements.

In order to reduce tube arcing and to minimize the damage caused thereby, it is common to design cathode-ray tubes with maximum electrode spacings, to minimize field gradients and to incorporate arc suppression systems into the tube.

Such an arc suppression structure is disclosed in U.S. Pat. No. 4,345,185 issued to Y. Kobori on Aug. 17, 1982 and discussed by Y. Kobori et al. in their paper entitled, "A Novel Arc-Suppression Technique For Cathode Ray Tubes", presented at the IEEE Chicago Spring Conference on Consumer Electronics, June 19, 1980. The structure disclosed in the Kobori patent requires that a ceramic resistor be connected between the G3 and G5 high voltage electrodes (typically 30 kV) and that another resistor be connected between the low voltage G4 electrode and the stem lead attached thereto. When arcing takes place between adjacent electrodes, the arc current may flow either from the G5 through G3 to the G2 or to the G4. A problem occurs when the initial arc and the resulting plasma generated thereby results in additional arcs, e.g., cascading arcs, between the other electrodes of the electron gun. A cascading arc is herein defined as a succession of rapidly initiating arcs between electrodes in high field regions of the electron gun which permit a sufficiently high arc current to pass between electrodes of the electron gun and into the receiver subsequently causing damage to the electron gun components and to the associated gun circuitry.

Therefore, an arc-suppression system must be able to protect the electron gun not only from the effects of individual arcs but from the effects of cascading arcs. Arc suppression systems that protects electron guns from individual arcs and greatly reduces the probability of the occurrence of cascading arcs and the damage therefrom are described in U.S. patent application Ser. Nos. 424,136, and 424,140, filed Sept. 27, 1982 by R. Stone and assigned to the assignee of the present invention. The Stone patent applications are incorporated by reference herein for the purpose of disclosure. The Kobori patent referenced above and the Stone patent applications utilize resistors attached to the surfaces of the electrode members to provide arc suppression. The resistors are located between the external surfaces of the electrodes and the inside surface of the neck of the envelope so that the resistors disrupt the electric field in the vicinity of the electron gun. In some embodiments of the first named Stone patent application and in the Kobori patent, the arc suppression resistor spans an intermediate electrode which is operating at a significantly different voltage from that applied to the electrodes to which the resistor is attached, further disturbing the electric field of the gun. Furthermore, unless the resistor is attached carefully to the electrodes of the electron gun, burrs or braze material at the points of attachment may provide a site on the electrodes for the initiation of an arc. Thus, it is desirable wherever possible, to locate the arc suppression resistor where it will not disturb the electric field of the electron gun.

SUMMARY OF THE INVENTION

An electron gun comprises at least one cathode for generating an electron beam and a plurality of electrodes for directing the beam along a beam path. The electrodes include at least one accelerating and focusing electrode which is a split member having two spaced apart electrode sections. The electron gun also includes at least one arc-suppression resistor which interconnects the spaced apart sections of the split electrode. The resistor interconnecting the spaced apart sections is located in a zero electric field gradient area of the split member and extends along the beam path.

DETAILED DESCRIPTION OF THE PREFERRED EMBODIMENT

Figure 1:
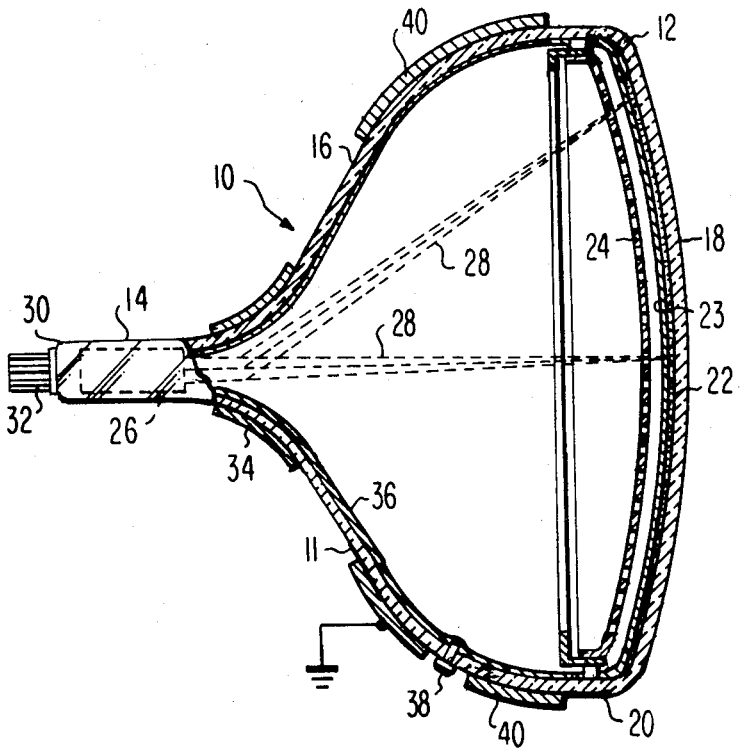
FIG. 1 is a plan view, partially in axial section, of a color cathode-ray tube (CRT) in which the present invention is incorporated.

FIG. 1 is a plan view of a rectangular color cathode-ray tube (CRT) or picture tube 10 having an evacuated glass envelope 11 comprising a rectangular faceplate panel 12 and a tubular neck 14 connected by a rectangular funnel 16. The panel comprises a viewing faceplate 18 and a peripheral flange or sidewall 20 which is sealed to the funnel 16. A mosaic three-color phosphor screen 22, which is backed by a reflection metal layer 23 of aluminum metal, is supported on the inner surface of the faceplate 18. The screen 22 may be either a line screen or a dot screen. A multiapertured color selection electrode or shadow mask 24 is removably mounted, by conventional means, in predetermined spaced relation to the screen 22. A novel in-line bipotential electron gun 26, shown schematically by dashed lines in FIG. 1, is centrally mounted within the neck 14 to generate and direct three electron beams 28 along spaced, co-planar convergent beam paths through the mask 24 to the screen 22. The end of the neck 14 is closed by a stem 30 having terminal pins or stem leads 32 on which the electron gun 26 is mounted and through which electrical connections are made to the various elements of the electron gun 26.

The tube of FIG. 1 is designed to be used with an external magnetic deflection yoke, such as the yoke 34 schematically shown surrounding the neck 14 and funnel 16 in the neighborhood of their junction. The yoke 34 subjects the three beams 28 to vertical and horizontal magnetic flux to scan the beams horizontally and vertically, respectively, in a rectangular raster over the screen 22.

Figure 2:
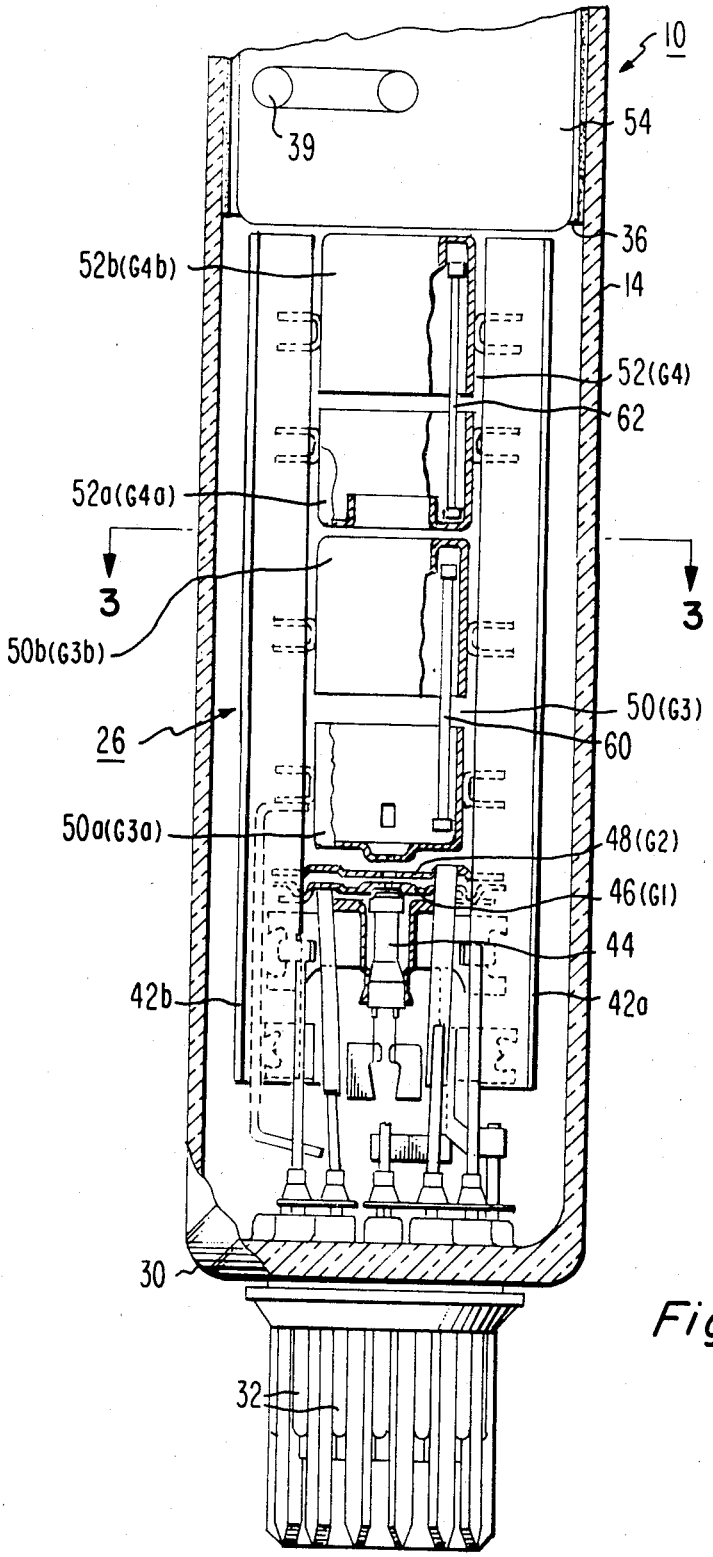
FIG. 2 is a side elevational view of a novel electron gun according to the present invention having two resistors interconnecting two pairs of electrodes.

An opaque, conductive coating 36 comprising graphite, iron oxide and a silicate binder is provided on the inner surface of the funnel 16. The coating 36 has a resistance of about 100 ohms and is electrically connected to the high voltage terminal or anode button 38 in the funnel 16. As shown in FIG. 2, the coating 36 extends into the neck 14 and is contacted by three bulb spacers 39 (only one of which is shown), which are preferably made of spring steel, and which also center and position the extended end of the electron gun 26, with the longitudinal axis of the tube 10.

An outer conductive coating 40, which is maintained at ground potential, is provided on the outside surface of the funnel 16. The inner and outer conductive coatings 36 and 40 constitute a high voltage filter capacitor. The capacitive value of the filter capacitor is about 1000 picofarads.

The novel in-line bipotential electron gun 26 shown in FIG. 2 comprises two glass support rods or beads **42*a* and 42*b* from which the various electrodes are supported to form a coherent unit in a manner commonly used in the art. The beads 42*a* and 42*b* usually extend from a region close to the stem 30 where the ambient electric fields are small, to the region of the electrode to which the ultor potential is applied, where the ambient electric fields are high during the operation of the tube. These electrodes include three substantially equally transversely-spaced coplanar cathodes 44 (one for producing each beam, although only one if shown), a control-grid electrode 46 (also referred to as G1), a screen-grid electrode 48 (also referred to as G2), a first accelerating and focusing electrode 50 (also referred to as G3), a second accelerating and focusing electrode 52 (also referred to as G4), and a shield cup 54, longitudinally-spaced in that order along the rods 42*a* and 42*b*. Several of the various electrodes of the electron gun 26 are electrically connected to the pins 32 either directly or through metal ribbons 56. The electron gun 26 is held in a predetermined position in the neck 14 on the pins 32 and with the bulb spacers 39 on the shield cup 54 which press on and make contact with the internal coating 36**.

Figure 3:
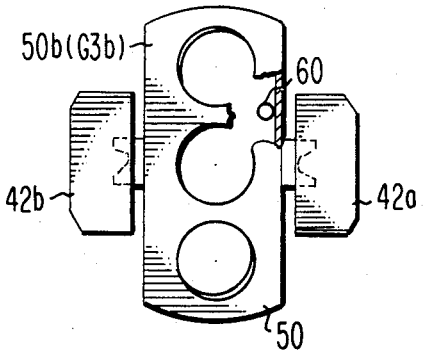
FIG. 3 is a plan view, partially broken-away, of a split electrode, showing the relative location of an arc suppression resistor within the split electrode, taken along line 3—3 of FIG. 2.
Figure 4:
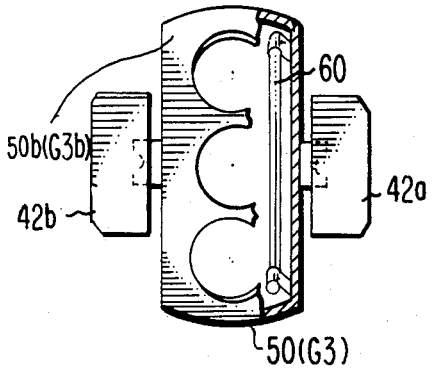
FIG. 4 is a plan view, partially broken-away, of a split electrode, showing an alternative location of an arc suppression resistor within the split electrode, taken along line 3—3 of FIG. 2.
Figure 5:
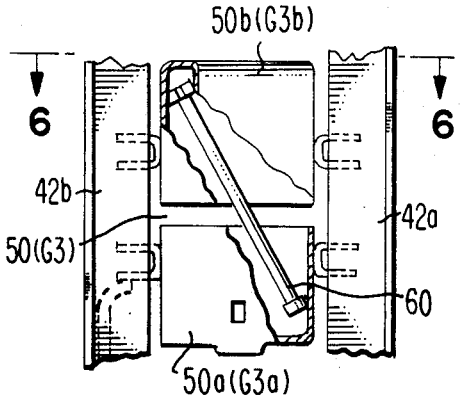
FIG. 5 is a side elevational view, partially broken-away, of a fragment of a novel electron gun showing a split electrode with a second alternative location of an arc suppression resistor within the split electrode.
Figure 6:
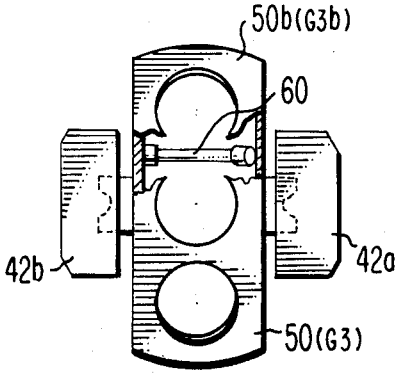
FIG. 6 is a plan view, partially broken-away, showing the second alternative location of the arc suppression resistor, taken along line 6—6 of FIG. 5.

The electron gun 26 has a split G3 member 50, comprising a G3*a* or first cup-shaped proximal electrode section **50*a*** and a G3*b* or first cup-shaped distal electrode section **50*b*. The electron gun 26 also includes a split G4 member 52** comprising a G4*a* or second cup-shaped proximal electrode section **52*a*** and a G4*b* or second cup-shaped distal electrode section **52*b*. Each of the cup-shaped sections 50*a*, 50*b*, 52*a* and 52*b* has a central beam aperture and a pair of outer beam apertures therethrough. The open ends of the cup-shaped sections are spaced apart in facing relation and axially separated along a plane substantially perpendicular to the beam paths. The terms proximal and distal refer to positions relative to the cathodes 44, wherein the proximal split electrode members are nearer to the cathodes than the corresponding distal split electrode members. A first arc-suppression resistor 60** is interconnected, e.g., by welding or brazing, between the G3*a* and G3*b* electrode members **50*a* and 50*b* of the G3 electrode 50. The end of the resistor 60, which is attached to electrode member 50*a*, is electrically connected, through member 50*a*, to one of the stem leads 32. A second arc-suppression resistor 62** is interconnected, also by welding or brazing, between the G4*a* and G4*b* electrode members **52*a* and 52*b* of the G4 electrode 52. The end of the resistor 62 that is connected to electrode member 52*b* is also connected, through bulb spacers 39, to inner coating 36. The resistors 60 and 62 are disposed within the electrodes 50 and 52 and located between the center beam apertures and one of the outer beam apertures, in the manner shown in FIGS. 2 and 3, to avoid disrupting the electric field between the electron gun 26 and the neck 14 of the tube 10. The resistors 60 and 62 are disposed along, i.e., generally parallel to, the electron beam path so as not to interfere with the electron beam. The phenomenon of electrical breakdown involving the neck glass of the tube envelope is described in U.S. Pat. No. 4,288,719 issued to K. G. Hernqvist on Sept. 8, 1981 and incorporated herein for the purpose of disclosure. One of the causes of such breakdown is points or protrusions in the neck region provide a site for field emitted electrons which strike the neck glass. By locating the arc-suppression resistors 60 and 62 within the split electrodes 50 and 52, i.e., within zero field gradient areas of the electron gun 26, the resistors 60 and 62 cannot contribute to breakdown of the neck glass and can function as current limiting resistors in the event of electrical breakdown or arcing between the electrodes of the electron gun as described in the above-referenced copending patent application by Stone. Alternative locations for the arc suppression resistors within the split electrodes are shown for the split G3 electrode 50 in FIGS. 4, 5 and 6. In FIG. 4, the resistor 60** extends diagonally across the G3*a* and G3*b* electrode members 50*a* and 50*b* to one side of the electron beam paths. In FIGS. 5 and 6, the resistor 60 extends diagonally across the G3*a* and G3*b* electrode members 50*a* and 50*b* in such a manner as to be located between the center beam path and one of the outer beam paths.

While the invention is described in terms of an in-line bipotential electron gun having two split electrodes, the concept of locating the arc-suppression resistors within adjacent sections of split electrode members so that the resistors are in a zero field gradient region of the electron gun is applicable to other types of electron guns utilizing arc-suppression resistors, such as those disclosed in the aforementioned copending patent applications by Stone. It should also be clear to one skilled in the art that the present invention may be utilized in single beam cathode ray tubes as well as in tubes having a delta gun.

The use of arc-suppression resistors within the electron gun does not inhibit the normal tube processing procedures which include spot-knocking of the electron gun electrodes as well as low voltage aging.

What is claimed is:

1. In a electron gun comprising at least one cathode for generating an electron beam, a plurality of electrodes for directing said electron beam along a beam path, and at least one arc-suppression resistor, said electrodes including at least one accelerating and focusing electrode comprising a split member having two spaced apart electrode sections, the spaced apart sections being interconnected by said arc-suppression resistor, wherein the improvement comprises the resistor interconnecting the spaced apart sections of said split member being located in a zero electric field gradient area of said split member and extending along the beam path.

2. In a cathode ray tube including an evacuated envelope having therein a phosphor screen, an electron gun with a plurality of cathodes for generating a plurality of electron beams along spaced beam paths toward said screen, a plurality of electrodes for focusing and accelerating the electron beams of said electrodes, the electrodes including a control-grid electrode, a screen grid electrode, at least one low voltage accelerating and focusing electrode and at least one high voltage accelerating and focusing electrode, at least one of said accelerating and focusing electrode being a split member comprising a first and a second section disposed with their open ends spaced apart in facing relation, and at least one arc-suppression resistor, said sections of said split member being interconnected by said resistor, wherein the improvement comprises the resistor interconnecting said first and second sections of said split member being located in a zero electric field gradient area within said sections and extending along the beam paths.

3. The cathode ray tube as described in claim 2 wherein said low voltage accelerating and focusing electrode is the split member.

4. The cathode ray tube as described in claim 2 wherein both said low voltage and said high voltage accelerating and focusing electrodes are split members.

5. The cathode ray tube as described in claim 2 wherein said resistor extending along the beam paths is disposed diagonally within said split member.

6. The cathode ray tube as described in claim 5 wherein the resistor extending diagonally within the split member is located to one side of the beam paths.

7. The cathode ray tube as described in claim 5 wherein the resistor extending diagonally within the split member is located between adjacent beam paths.

8. In a color picture tube including an evacuated envelope comprising a faceplate and a neck connected by a funnel, a mosaic color phosphor screen on the inner surface of said faceplate, a multiapertured color selection electrode spaced from said screen, an in-line electron gun mounted in said neck for generating and directing three electron beams along spaced, coplanar beam paths through said color selection electrode to said screen, said electron gun including a plurality of gun electrodes and a plurality of arc-suppression resistors interconnecting selected ones of said gun electrodes, said gun electrodes including at least one accelerating and focusing electrode comprising a split member having a first and a second cup-shaped section, each of said cup-shaped sections of said split member having a central beam aperture and a pair of outer beam apertures therethrough, said sections being disposed with their open ends spaced apart in facing relation, said sections being interconnected by one of the resistors of said plurality of resistors, wherein the improvement comprises the resistor interconnecting said first and second cup-shaped sections of said split member being disposed within said split member in a zero electric field gradient area of said split member.

9. The color picture tube as described in claim 8 wherein a plurality of accelerating and focusing electrodes comprise split members having a first and second section.

* * * * *